US008526154B2

(12) United States Patent
Volz et al.

(10) Patent No.: US 8,526,154 B2
(45) Date of Patent: Sep. 3, 2013

(54) CURRENT TRANSFORMER ASSEMBLY AND ELECTROMECHANICAL SWITCHING DEVICE

(75) Inventors: Mathias Volz, Oldenburg (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 302 days.

(21) Appl. No.: 12/935,618

(22) PCT Filed: Mar. 11, 2009

(86) PCT No.: PCT/EP2009/052834

§ 371 (c)(1),
(2), (4) Date: Sep. 30, 2010

(87) PCT Pub. No.: WO2009/121695

PCT Pub. Date: Oct. 8, 2009

(65) Prior Publication Data

US 2011/0018363 A1 Jan. 27, 2011

(30) Foreign Application Priority Data

Apr. 1, 2008 (DE) ..... 10 2008 018 261

(51) Int. Cl.
*H01H 73/00* (2006.01)

(52) U.S. Cl.
USPC ..... 361/115

(58) Field of Classification Search
USPC ..... 361/115
See application file for complete search history.

(56) References Cited

U.S. PATENT DOCUMENTS

| | | | | |
|---|---|---|---|---|
| 4,803,587 | A | 2/1989 | Fournier et al. | |
| 4,994,725 | A * | 2/1991 | Gschlossl | 318/727 |
| 5,483,212 | A * | 1/1996 | Lankuttis et al. | 335/132 |
| 5,755,589 | A * | 5/1998 | Koch | 439/427 |
| 6,222,713 | B1 | 4/2001 | Vix | |
| 6,304,049 | B1 * | 10/2001 | Fournier et al. | 318/520 |
| 6,472,837 | B1 * | 10/2002 | Caporalin et al. | 318/520 |
| 6,794,967 | B1 * | 9/2004 | Park | 335/159 |
| 2006/0197481 | A1 * | 9/2006 | Hotto et al. | 318/280 |
| 2010/0085135 | A1 | 4/2010 | Graf et al. | |

FOREIGN PATENT DOCUMENTS

| | | | |
|---|---|---|---|
| DE | 3713537 | A1 | 10/1987 |
| DE | 10023966 | C1 | 11/2001 |
| EP | 0955660 | A1 | 11/1999 |
| FR | 2664763 | A1 | 1/1992 |
| JP | 2005137147 | A | 5/2005 |
| WO | WO 2008034467 | A1 | 3/2008 |

OTHER PUBLICATIONS

Chinese Office Action dated Oct. 16, 2010 for corresponding Chinese Application No. 200980109697.3.

* cited by examiner

*Primary Examiner* — Scott Bauer
(74) *Attorney, Agent, or Firm* — Harness, Dickey & Pierce, P.L.C.

(57) ABSTRACT

A current transformer assembly includes input connections, output connections, current transformers placed between the input connections and the output connections, with at least one transformer output being electrically connected to the transformers. In at least one embodiment, the current transformer assembly includes an integrated wiring arrangement wherein a plurality of input connections is electrically connected to a plurality of output connections by way of the integrated wiring arrangement such that the wiring arrangement functions as an alternating wiring system.

21 Claims, 4 Drawing Sheets

CURRENT TRANSFORMER ASSEMBLY AND ELECTROMECHANICAL SWITCHING DEVICE

PRIORITY STATEMENT

This application is the national phase under 35 U.S.C. §371 of PCT International Application No. PCT/EP2009/052834 which has an International filing date of Mar. 11, 2009, which designates the United States of America, and which claims priority on German patent application number DE 10 2008 018 261.3 filed Apr. 1, 2008, the entire contents of each of which are hereby incorporated herein by reference.

BACKGROUND

FIG. 3 shows a known prior art reversing circuit 30 having a protective element (circuit breaker 33) and two switching elements (contactors 31, 32). The circuit breaker 33 has an integrated short-circuit tripping device (instantaneous n-release) 35 and an overload tripping device (delayed-action p-release) 37.

The reversing circuit 30 is embodied for electrically connecting the phase inputs (L1, L2, L3) to the phase outputs (T1, T2, T3) with a direct phase sequence (L1→T1, L2→T2, L3→T3) or with a modified phase sequence (L1→T1, L2→T3, L3→T2). Furthermore, the phase inputs (L1, L2, L3) can also be electrically isolated from the phase outputs by means of the reversing circuit 30. In the case of the direct phase sequence an electric motor runs in a first direction, whereas in the case of the modified phase sequence it runs in the second direction.

As is well known, the reversing circuit 30 is controlled via the contactors 31, 32. Only one contactor 31, 32 is activated in each case or both of the contactors 31, 32 remain deactivated. The wiring arrangement 34 upstream of the contactors 31, 32 and the reversing wiring arrangement downstream of the contactors 31, 32 are necessary for a reversing circuit.

The wiring arrangement 34 together with the reversing wiring arrangement 36 causes greater installation overhead and is prone to installation errors.

SUMMARY

At least one embodiment of the invention reduces the installation overhead and/or the susceptibility to faults or errors in the case of a reversing circuit.

At least one embodiment is directed to a current transformer assembly and/or an electromechanical switching device.

The dependent claims describe advantageous embodiment variants of the invention.

The wiring overhead can be reduced by way of a current transformer assembly having input terminals, output terminals, and current transformers which are placed between the input terminals and output terminals and to which at least one transformer output is electrically connected, and having an integrated wiring arrangement, wherein a number of input terminals are electrically connected to a number of output terminals via the integrated wiring arrangement in such a way that the wiring arrangement functions as a reversing wiring arrangement.

If the reversing wiring arrangement is embodied for electrically contacting three input terminals with a direct phase sequence and three input terminals with a modified phase sequence to the output terminals, the reversing wiring arrangement can be implemented in a simple manner by way of the transformer assembly.

If the input terminals are embodied as fixed contact makers of a switching element, the reversing circuit can be implemented in a compact design.

If the current transformer assembly additionally has integrated evaluation electronics, the latter being integrated on a printed circuit board for example, a compact, modular design is made possible.

The evaluation electronics can be connected in an elegant manner to at least one transformer output via a signal connection. Manufacturing tolerances can be better compensated for and a simple way/device of connection can be provided if the signal connection is implemented as a cable connection consisting of at least one male connector and a stranded wire conductor attached thereto, in particular if the male connector and the stranded wire conductor consist of flexible, electrically conductive material such as metal.

If the stranded wire conductor is fixed onto the printed circuit board by means of at least one solder point, contact failures can be avoided more effectively.

The wiring overhead can be reduced by way of an electromechanical switching device having a number of switching points which can be controlled by at least one associated electromechanical controller, and by way of a current transformer assembly, wherein the input terminals are electrically connected to the switching points. It is also possible to make the switching device more compact.

If the at least one electromechanical controller is embodied in the switching device for the purpose of controlling the switching points in two groups in such a way that the electromechanical switching device in each case contacts its phase inputs (L1, L2, L3) in a direct phase sequence (L1→T1, L2→T2, L3→T3) or in a modified (L1→T1, L2→T3, L3→T2) phase sequence to the phase inputs (T1, T2, T3), the switching device can completely take over the function of the reversing circuit.

If the input terminals are a constituent part of the switching points, the switching device can be made even more compact.

It is possible for the current transformer assembly to be used as a signal generator for the at least one electromechanical controller. In that case a protective function can be implemented for the switching device in a relatively simple manner. For example, protection against overload or short-circuit can be achieved if the at least one electromechanical controller is embodied for disconnecting the phase inputs (L1, L2, L3) from the phase outputs (T1, T2, T3) if at least one signal transmitted via the transformer output shows that the current flowing through the electromechanical switching device exceeds a permitted value. By this means the switching element can assume the functions of a protective element, with the result that a compact reversing circuit having a protective function or protective functions is realized.

If the permitted value is selectable, the electromechanical switching device can be used in a more versatile manner.

BRIEF DESCRIPTION OF THE DRAWINGS

The invention is explained in more detail below with reference to example embodiment variants depicted in the attached drawings, in which.

Corresponding structural elements are labeled with the same reference signs in all the drawings.

DETAILED DESCRIPTION OF THE EXAMPLE EMBODIMENTS

Figure 1:
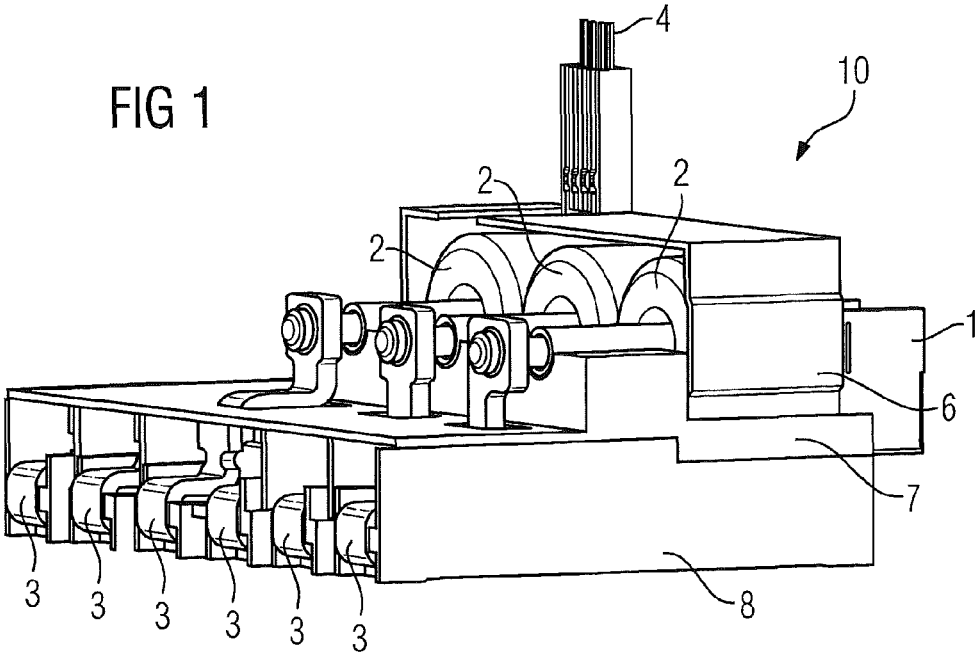
FIG. 1 shows a current transformer assembly.

FIG. 1 shows a current transformer assembly 10. The current transformer assembly 10 has input terminals 3, output terminals 1, and current transformers 2 which are placed between the input terminals 3 and output terminals 1. The current transformers 2 are embodied for measuring the electric current flowing in an electrical conductor between an input terminal 3 and an output terminal 1 and can be toroidal core transformers, for example.

At least one transformer output 4 is electrically connected to each current transformer 2. The output signals of the current transformers 2, up to three current transformers, can be multiplexed.

The housing of the current transformer group 10 advantageously consists of a base section 8, an intermediate section 7 and a top section 6.

Figure 2:
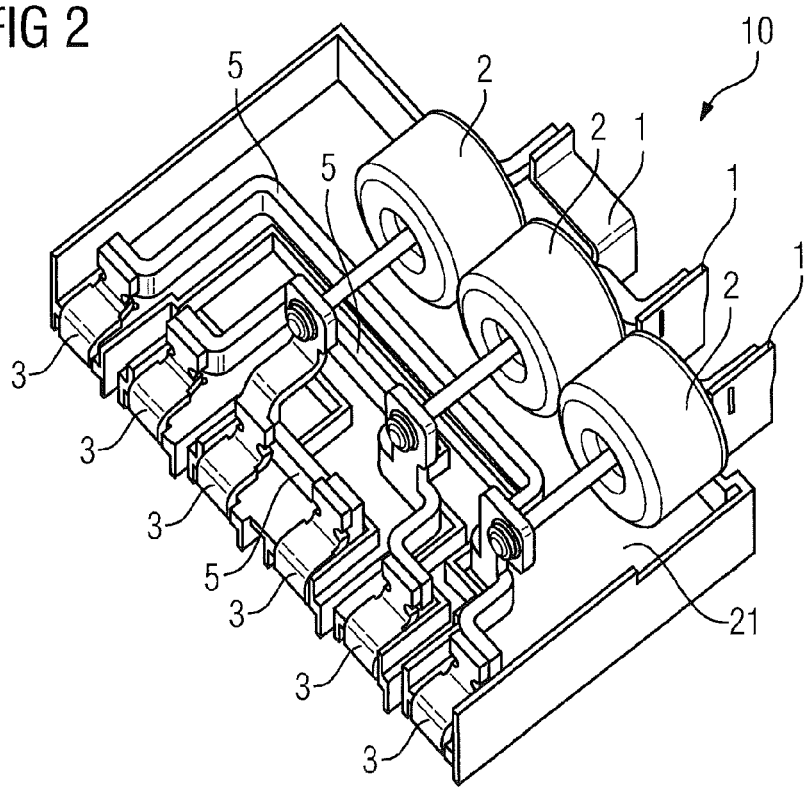
FIG. 2 shows a plan view of the current transformer assembly depicted in FIG. 1, with the top section of the housing removed.
Figure 3:
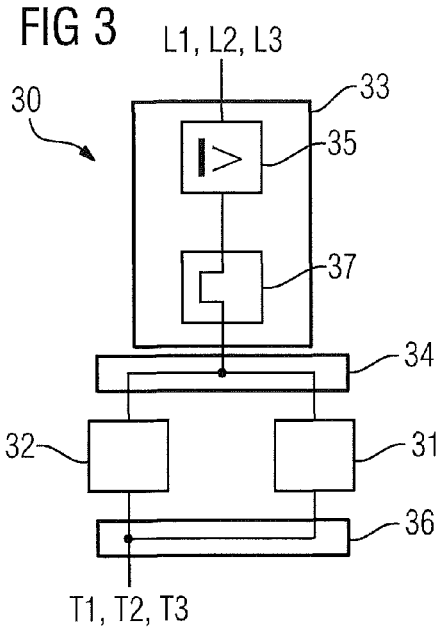
FIG. 3 shows a reversing circuit.

FIG. 2 shows a plan view of the current transformer assembly 10 depicted in FIG. 1 with the top section 6 of the housing removed.

According to an example embodiment of the invention the current transformer assembly 10 has an integrated wiring arrangement 5, such that a number of input terminals 3 are electrically connected to a number of output terminals 1 via the integrated wiring arrangement 5 in such a way that the integrated wiring arrangement 5 functions as a reversing wiring arrangement.

Figure 4:
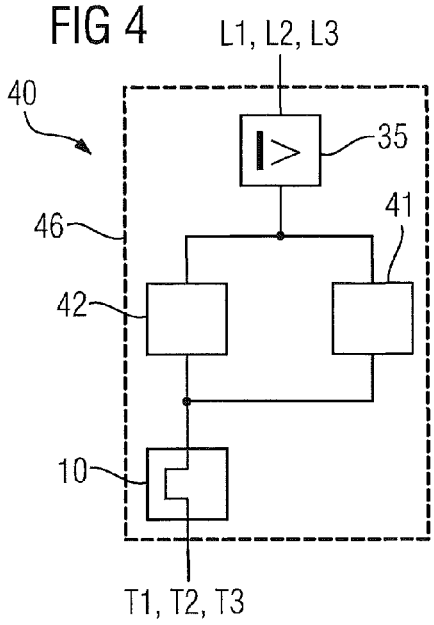
FIG. 4 shows an electromechanical switching device.
Figure 5:
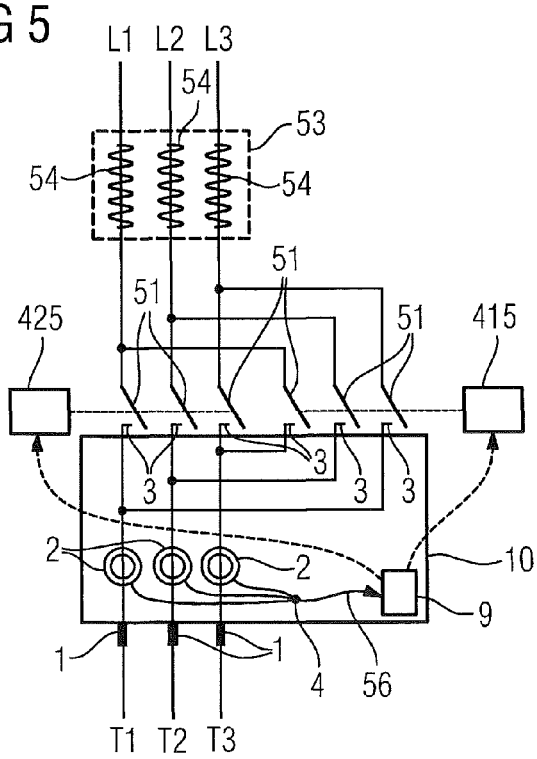
FIG. 5 shows a circuit diagram of the electromechanical switching device depicted in FIG. 4.
Figure 6:
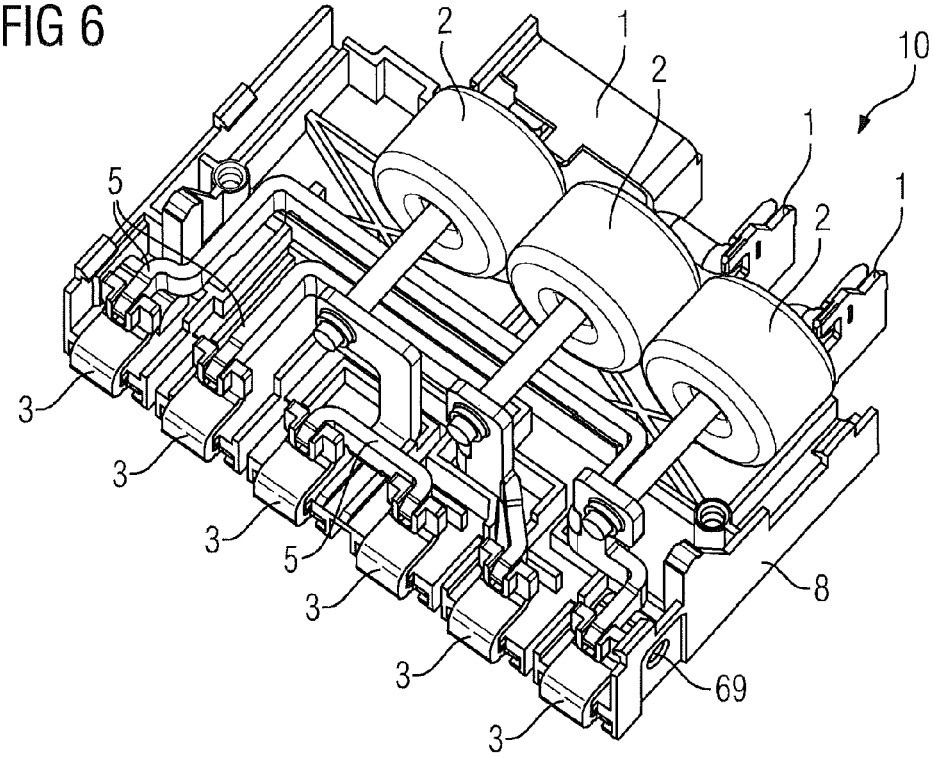
FIGS. 6 and 7 show two current transformer assemblies.
Figure 7:
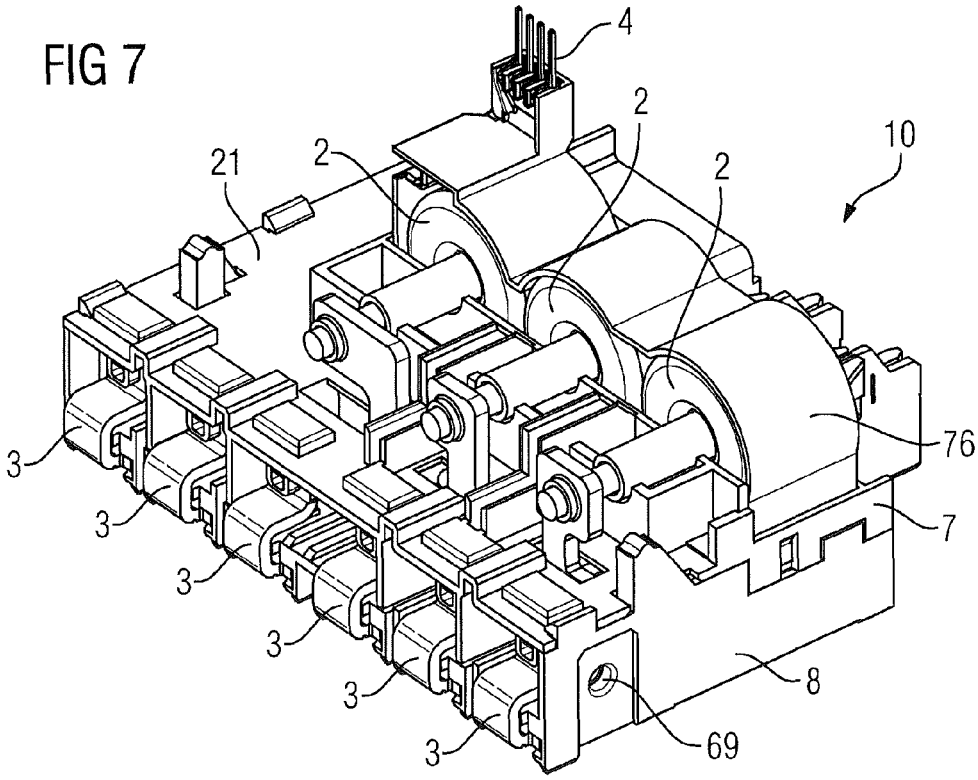

FIGS. 4 and 5 show how the current measurement is realized in the case of an electromechanical switching device 40 by way of one or more current transformers 2. The transformer signals coming from the transformer output 4 of the transformer assembly 10 are transmitted to the printed circuit board 21 which contains the evaluation electronics 9. The signal connection 56 is advantageously implemented by means of a cable connection, with the male connector establishing the electrical connection to the transformer assembly 10 and the stranded wire conductor 81 being fixed onto the printed circuit board 21 by way of a soldered joint.

The reversing wiring arrangement 5 is embodied for electrically contacting three input terminals 3 with a direct phase sequence (L1→T1, L2→T2, L3→T3) and three input terminals 3 with a modified phase sequence (L1→T1, L2→T3, L3→T2) to the output terminals 1.

The current transformer assembly 10 is equipped with three current transformers 2. It is, however, possible for the current transformer assembly 10 to be implemented with only one current transformer or two current transformers.

The input terminals 3 are embodied as fixed contact makers of a switching element. This is illustrated with reference to FIGS. 4 and 5. In this case the current transformer assembly 10 is connected in an electrically conductive manner to the electromechanical switching device 40. In the example shown, the current transformer assembly 10 is integrated with the switching device 40.

The electromechanical switching device 40 is provided with a number (three, six) of switching points 51 which can be controlled by at least one associated electromechanical controller 41S, 42S. The electromechanical switching device 40 additionally has a current transformer assembly 10. The input terminals 3 are electrically connected to the switching points 51. In order to make the design of the electromechanical switching device more compact, the input terminals 3 are in each case a constituent part of the corresponding switching points 51, with the input terminals then being able to ensure the transmission of current from the moving contact makers of the switching point 51.

Figure 8:
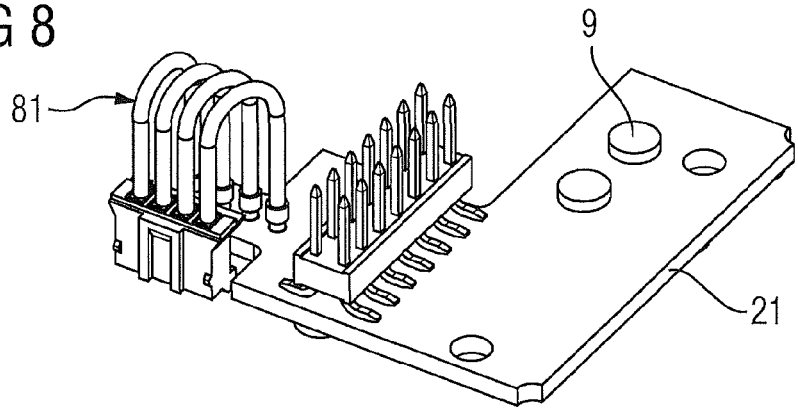
FIG. 8 shows a printed circuit board with a soldered-on stranded wire conductor for the signal connection.
Figure 9:
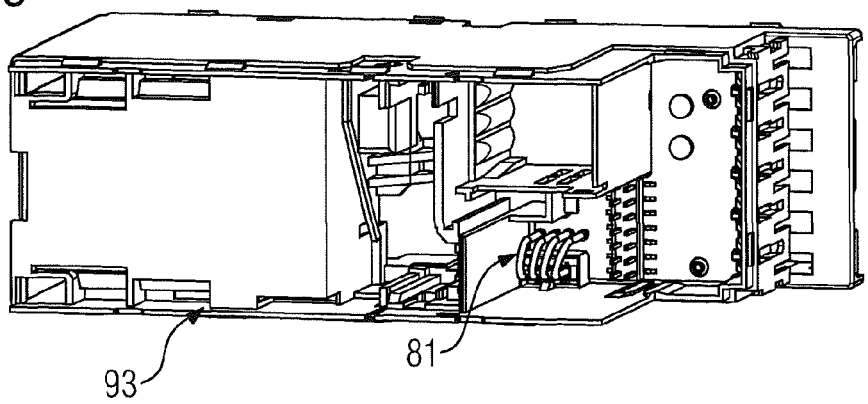
FIG. 9 shows a fixing of the male connector in the housing of an electromechanical switching device.
Figure 10:
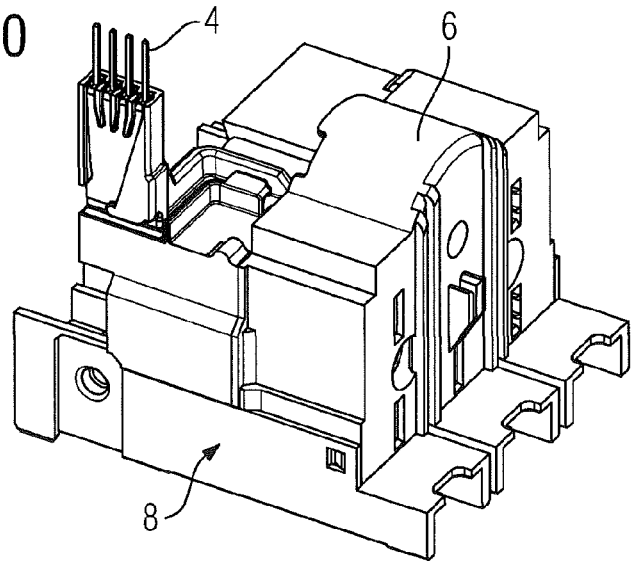
FIG. 10 shows a transformer assembly.

The current transformer assembly 10 has integrated evaluation electronics 9 which can be integrated on a printed circuit board 21 (see FIG. 8). The evaluation electronics 9 is connected via a signal connection 56 to the transformer output 4, the signal connection 56 consisting of at least one male connector and a stranded wire conductor 81 attached thereto. The stranded wire conductor 81 is fixed onto the printed circuit board 21 by means of one or more solder points.

Owing to the flexibility of the stranded wire conductor 81, mechanical shocks from the switching of the contactor drive unit of the electronic protection device 40 are more effectively avoided and tolerances of the components virtually completely compensated for.

The soldered connections on the printed circuit board 21 to the stranded wire conductor 81 help to avoid contact failures; installation advantages are also produced thanks to the flexibility of the stranded wire conductor 81. An easy means of contacting the transformer signals via the male connector with stranded wire conductor 81 is also created.

The electromechanical controllers 41S and 42S are embodied for controlling the switching points 51 in two groups in such a way that the electromechanical switching device 40 in each case contacts its phase inputs (L1, L2, L3) in a straight (L1→T1, L2→T2, L3→T3) or in a modified (L1→T1, L2→T3, L3→T2) phase sequence to the phase outputs (T1, T2, T3). The electromechanical controllers 41S, 42S are, for example, solenoid actuators that can be controlled by analog or digital devices.

The current transformer assembly 10 is used as a signal generator for the electromechanical controllers 41S, 42S.

The electromechanical controllers 41S, 42S are embodied for disconnecting the phase inputs (L1, L2, L3) from the phase outputs (T1, T2, T3) if at least one signal transmitted via the transformer output 4 shows that the current flowing through the electromechanical switching device 40 exceeds a permitted value. The permitted value is advantageously selectable so that the overload protection function implemented by means of the transformer assembly 10 (cf. with the overload tripping device 37) can be set according to the load used (e.g. rated motor loading).

The contacting of the transformer assembly 10 is realized by way of a male/female (plug and socket) connector system on the printed circuit board 21 to the evaluation electronics 9. The winding wire of the current transformers 2 is combined in the male connector and then plugged into the female socket. The female socket is connected to the printed circuit board 21 and the evaluation electronics 9.

The signal connection 56 of the transformers 2 to the evaluation electronics 9, the latter being fixed in this case on the printed circuit board 21, is achieved by means of a cable connection. The cable connection consists of a male connector and a stranded wire conductor 81 attached thereto. The stranded wire conductor is fixed onto the printed circuit board 21 by way of a solder point. The male connector is plugged onto the transformer assembly 10 in order to tap the measurement signals, the connector being fixed in a between the housing 93 (magnetic chamber of the electromechanical switching device) and then contacted by the transformer assembly 10.

By way of an embodiment of the invention, it is possible to implement optimal signal transmission in the case of an overall installation width of 90 mm of low-voltage switchgear (voltages up to 1000 volts) with reversing wiring arrangement.

The short-circuit protection function 35 can be integrated into the electromechanical protection device 40.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A current transformer assembly comprising:

input terminals coupled to input lines via at least one electromechanical switching device;

output terminals, wherein the output terminals are fixed to the input terminals;

current transformers, placed between the input terminals and output terminals, to which at least one transformer output is electrically connected; and an integrated wiring arrangement configured to electrically connect each of the input terminals to one of the output terminals in such a way that the integrated wiring arrangement functions as a reversing wiring arrangement.

2. The current transformer assembly as claimed in claim 1, wherein the reversing wiring arrangement is embodied for electrically contacting three input terminals with a direct phase sequence and three input terminals with a modified phase sequence to the output terminals.

3. The current transformer assembly as claimed in claim 1, wherein the current transformer assembly is equipped with up to three current transformers.

4. The current transformer assembly as claimed in claim 1, wherein the input terminals are embodied as fixed contact makers of a switching element.

5. The current transformer assembly as claimed in claim 1, wherein the current transformer assembly additionally includes integrated evaluation electronics.

6. The current transformer assembly as claimed in claim 5, wherein the evaluation electronics is connected via a signal connection to at least one transformer output and wherein the signal connection is implemented as a cable connection consisting of at least one male connector and a stranded wire conductor attached thereto.

7. The current transformer assembly as claimed in claim 6, including a printed circuit board, wherein the stranded wire conductor is fixed onto the printed circuit board by way of one or more solder points.

8. The current transformer assembly as claimed in claim 1, wherein the current transformer assembly is connected in an electrically conductive manner to the at least one electromechanical switching device.

9. An electromechanical switching device comprising:

a plurality of electromechanical switches controllable by at least one associated electromechanical controller; and a current transformer assembly as claimed in claim 1.

10. The electromechanical switching device as claimed in claim 9, wherein the at least one electromechanical controller is embodied for controlling the plurality of electromechanical switches in two groups in such a way that the electromechanical switching device, in each case, contacts the input terminals in a direct phase sequence or in a modified phase sequence.

11. The electromechanical switching device as claimed in claim 9, wherein the current transformer assembly is integrated with the electromechanical switching device.

12. The electromechanical switching device as claimed in claim 9, wherein the input terminals are a constituent part of the plurality of electromechanical switches.

13. The electromechanical switching device as claimed in claim 9, wherein the current transformer assembly is used as a signal generator for the at least one electromechanical controller.

14. The electromechanical switching device as claimed in claim 13, wherein the at least one electromechanical controller is embodied for disconnecting at least one of the plurality of input lines from one of the input terminals if at least one signal transmitted via the output terminals shows that the current flowing through the electromechanical switching device exceeds a permitted value.

15. The electromechanical switching device as claimed in claim 14, wherein the permitted value is selectable.

16. The current transformer assembly as claimed in claim 2, wherein the current transformer assembly is equipped with up to three current transformers.

17. The current transformer assembly as claimed in claim 5, wherein the integrated evaluation electronics is integrated on a printed circuit board.

18. The current transformer assembly as claimed in claim 5, wherein the evaluation electronics is connected via a signal connection to at least one transformer output.

19. The electromechanical switching device as claimed in claim 10, wherein the current transformer assembly is integrated with the switching device.

20. The electromechanical switching device as claimed in claim 10, wherein the input terminals are a constituent part of the plurality of electromechanical switches.

21. The electromechanical switching device as claimed in claim 10, wherein the current transformer assembly is used as a signal generator for the at least one electromechanical controller.

* * * * *